US008855538B2

(12) United States Patent
Ruiz et al.

(10) Patent No.: US 8,855,538 B2
(45) Date of Patent: Oct. 7, 2014

(54) APPARATUS AND METHOD FOR CLEANING A PRESSURE ROLL OF A FUSER UNIT AS USED IN PRINTING

(71) Applicant: Xerox Corporation, Norwalk, CT (US)

(72) Inventors: Erwin Ruiz, Rochester, NY (US); Jeffrey Nyyssonen Swing, Rochester, NY (US); David S. Derleth, Webster, NY (US); Charles T. Facchini, II, Webster, NY (US); Steven Russel, Bloomfield, NY (US); Jorge M. Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 46 days.

(21) Appl. No.: 13/685,736

(22) Filed: Nov. 27, 2012

(65) Prior Publication Data

US 2014/0147179 A1 May 29, 2014

(51) Int. Cl.
*G03G 15/20* (2006.01)

(52) U.S. Cl.
CPC ..... *G03G 15/2075* (2013.01)
USPC ..... 399/327; 399/325; 399/326

(58) Field of Classification Search
USPC ..... 399/325–327
See application file for complete search history.

(56) References Cited

U.S. PATENT DOCUMENTS

| | | | | |
|---|---|---|---|---|
| 3,718,116 | A * | 2/1973 | Thettu | 118/266 |
| 3,861,860 | A * | 1/1975 | Thettu et al. | 432/59 |
| 4,040,383 | A * | 8/1977 | Vandervort | 399/325 |
| 4,087,676 | A * | 5/1978 | Fukase | 219/216 |
| 4,324,482 | A * | 4/1982 | Szlucha | 399/327 |
| 4,426,953 | A * | 1/1984 | Kromm et al. | 118/60 |
| 4,521,184 | A * | 6/1985 | Samuels et al. | 432/60 |
| 4,777,903 | A * | 10/1988 | Wilcox | 118/60 |
| 5,049,944 | A * | 9/1991 | DeBolt et al. | 399/325 |
| 5,512,729 | A * | 4/1996 | Kusaka et al. | 219/216 |
| 7,376,378 | B2 * | 5/2008 | Van Bortel | 399/325 |
| 7,437,111 | B2 * | 10/2008 | Yamada et al. | 399/327 |
| 7,769,338 | B2 | 8/2010 | Ferrar et al. | |
| 2003/0095817 | A1 * | 5/2003 | Aslam et al. | 399/327 |
| 2005/0201785 | A1 * | 9/2005 | Gila et al. | 399/348 |
| 2007/0098469 | A1 * | 5/2007 | Yoshino et al. | 399/340 |
| 2008/0226335 | A1 * | 9/2008 | Van Sas et al. | 399/101 |
| 2009/0297234 | A1 * | 12/2009 | Cahill | 399/327 |
| 2012/0155929 | A1 | 6/2012 | Barton et al. | |

* cited by examiner

*Primary Examiner* — G. M. Hyder
(74) *Attorney, Agent, or Firm* — Ronald E. Prass, Jr.; Prass LLP

(57) ABSTRACT

An apparatus and method are provided for cleaning a pressure roll of a fuser unit useful in printing by way of a cleaning member having a compressible surface portion configured to contact the pressure roll, the compressible surface portion comprising a porous material configured to absorb a release agent from the pressure roll.

20 Claims, 5 Drawing Sheets

APPARATUS AND METHOD FOR CLEANING A PRESSURE ROLL OF A FUSER UNIT AS USED IN PRINTING

FIELD OF DISCLOSURE

The disclosure relates to an apparatus and method for cleaning a pressure roll of a fuser unit.

BACKGROUND

Various printing systems form an image on a media by way of an imaging surface such as, for example, a photoreceptor. The image is often fixed to the media by a fusing process. The fusing process conventionally involves advancing the media having the image through a fuser unit of the printing system. Fuser units often include a fixing roll and a pressure roll. Printing systems conventionally apply a release agent to the fixing roll to aid in stripping the media from the fixing roll after the fusing process is complete. Some of this release agent is inadvertently transferred from the fixing roll to the pressure roll in an inter-document zone that occurs between sheeted media processed by the printing system.

Release agent builds on the pressure roll and is often carried back to the imaging surface during a duplex printing mode. This release agent carried back to the imaging surface causes image related defects.

SUMMARY

Therefore, there is a need for an apparatus and method to clean a pressure roll of a fuser unit.

According to one embodiment, an apparatus for cleaning a pressure roll of a fuser unit comprises a cleaning member having a compressible surface portion configured to contact the pressure roll, the compressible surface portion comprising a porous material configured to absorb a release agent from the pressure roll.

According to another embodiment, a method for cleaning a pressure roll of a fuser unit comprises causing, at least in part, a cleaning member having a compressible surface portion configured to contact the pressure roll, the compressible surface portion comprising a porous material configured to absorb a release agent from the pressure roll.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Figure 1:
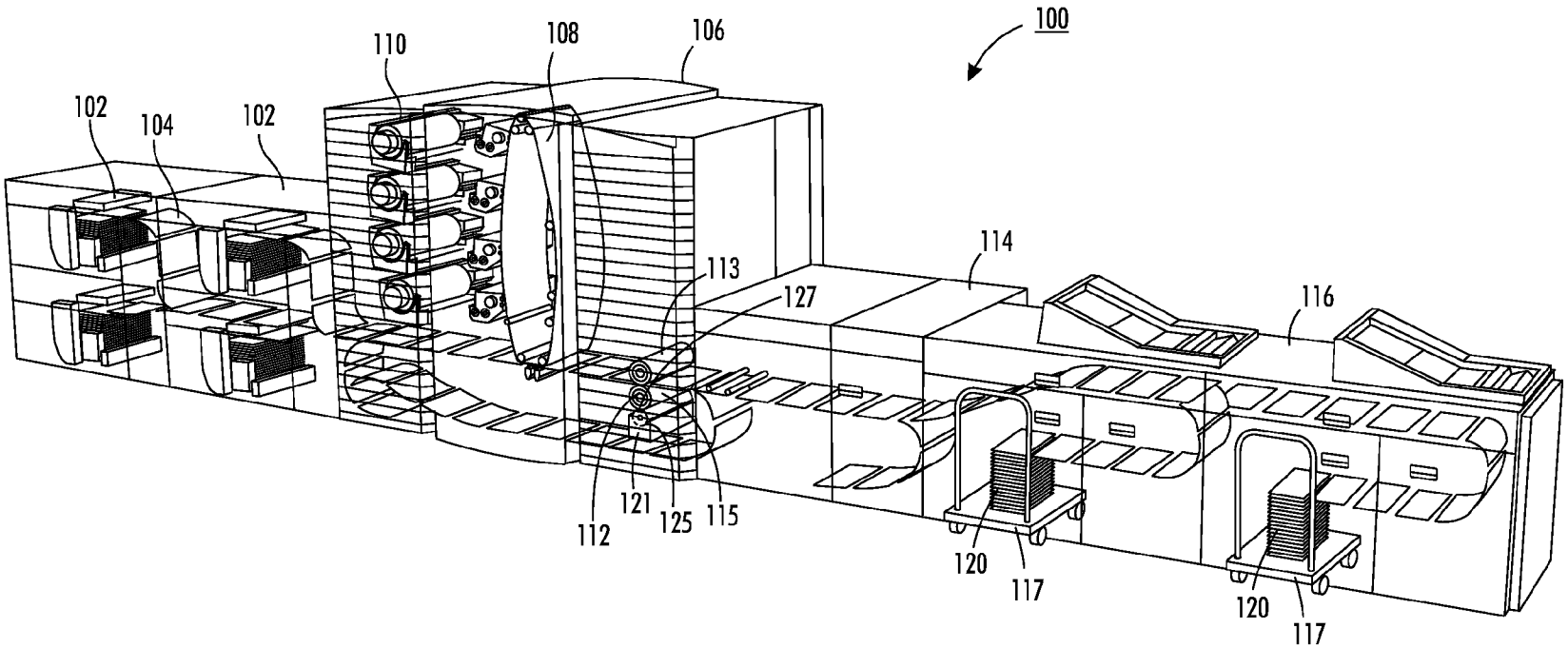
FIG. 1 is a diagram of a printing system having a fuser unit and a cleaning unit, according to one embodiment.

Examples of an apparatus and method for cleaning a pressure roll of a fuser unit are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "print job attribute," and any derivation thereof, refers to any descriptive property of a print job to be processed by a printing system. For example, a print job may be a simplex (one-sided printing) or duplex (two-sided printing) type, a print job may have a particular run length, a print job may have a predetermined expected quality threshold, etc.

As used herein, the term "imaging surface," and any derivation thereof, shall mean any member, such as a platen, belt, or drum, which accepts marking material, such as ink or toner, in image-wise fashion for eventual transfer to a print medium and subsequent cleaning. Although the illustrated embodiments shows an imaging surface as part of a photoreceptor belt used in image-on-image electrophotography, it will be understood that imaging surfaces, as the term is used herein, are apparent in other types of printing apparatus, such as an intermediate belt as used in tandem color electrophotography, a charge receptor such as used in ionography, or an intermediate drum or belt such as used in any type of ink jet printing.

As used herein, the term "release agent," and any derivation thereof, refers to a material or fluid such as an oil, silicone liquid, lubricant, non-stick spray, etc. that is applied to aid in stripping of a media substrate from a fixing roll of a fuser unit.

As used herein, the term "nanowire mesh," and any derivation thereof, refers to a material configured to absorb a release agent by way of capillary action. A nanowire mesh material includes a plurality of nanowires having diameters less than or equal to a value on the order of tens of nanometers. For example, a nanowire mesh material may comprise a plurality of nanowires having diameters ranging between 10 nm and 100 nm. The nanowires may have the same or unequal diameters in a same nanowire mesh. The nanowires may also have lengths of 1,000 times or more a given diameter. The nanowires may have the same or unequal lengths in a same nanowire mesh. A nanowire mesh may take any form such as, but not limited to, a paper-like or a web-like form, or any form of which may be used, for example, to form bristles of a brush. A nanowire mesh material may comprise any number of materials including, but not limited to, metallic materials, non-metallic materials, polymers, ceramics, glasses, conducting materials, semiconducting materials, non-conducting materials, or any combination thereof. For example, the interwoven nanowire fibers may comprise a potassium manganese oxide.

As used herein, the term "porous material," or any variation thereof refers to a material that is configured to absorb a release agent by way of a capillary action. The release agent being drawn into the open cells of the material. A porous material may be, for example, an open cell porous silicone or a nanowire mesh, among others.

FIG. 1 illustrates a printing system 100 having a cleaning unit 121 capable of cleaning pressure roll 115 of a fuser unit 112 of the printing system 100, according to one embodiment. The printing system 100 can be used to apply images to many types of media, or substrates, having various sizes and weights. The printing system 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printer module 106, marking material (e.g., toner) is transferred from a series of developer stations 110 to the imaging surface 108 which may be, for example, a charged photoreceptor, to form toner images on the imaging surface 108 and produce the above-mentioned images on the media. The toner images are transferred to one side of media 104 fed through the paper path. The media 104 are advanced through the fuser unit 112 including a fixing roll 113 and pressure roll 115. The fixing roll 113 and the pressure roll 115 together forms a fusing nip. At the fusing nip, heat and pressure are applied to media 104 on which marking material has been applied to fix the marking material to the media 104.

The inverter module 114 manipulates media 104 exiting the printer module 106 by either passing the media 104 through to the stacker modules 116 in a case of simplex printing, or inverting and returning the media 104 to the printer module 106 for duplex printing. In the stacker modules 116, the printed media 104 are loaded onto stacker carts 118 to form stacks 120.

The imaging surface 108 can be contaminated by release agent, for example. Release agent is often applied to the fixing roll 113 by the printing system 100 to aid in stripping the media 104 from the fixing roll 113 following the above-mentioned fixing process. The release agent, however, may be carried back to the imaging surface 108 when the printing system 100 is operating in a duplex printing mode.

For example, release agent may be transferred from the fixing roll 113 to the pressure roll 115 in an inter-document zone that occurs between sheets of sheeted media 104 as the sheets of media 104 are processed by the printing system 100. The release agent that transfers to the pressure roll 115 is often transferred to a non-image side of the sheeted media 104 as the media 104 passes through the fuser unit 112. The release agent that is transferred to the media 104 is then carried back to the imaging surface 108 causing image related defects.

Image related defects such as, but not limited to, ghosting, often occur when the imaging surface 108 is contaminated. Image related defects cause print production delays and reduce production efficiency. For example, a printing process may need to be stopped and started, or delayed, to correct any detected image related defects.

Conventional solutions for correcting the image defect problem include running clean up sheets through a conventional printing system to clean the imaging surface 108. For example, the clean up sheets may be used to absorb any release agent that has built up on the imaging surface 108, and/or a cleaning blade may be used to scrape any built up release agent from the imaging surface 108. Neither solution, however, effectively cleans the imaging surface 108 to eliminate the above-mentioned image related defects. Other solutions include replacing the imaging surface 108 and/or the fixing roll 113, for example. Such replacement solutions are expensive and time consuming.

To address these problems, the printing system 100 includes the cleaning unit 121 capable of cleaning release agent from the pressure roll 115. While FIG. 1 illustrates the cleaning unit 121 as being part of the printing system 100, the cleaning unit 121 may alternatively be configured to be a modular unit that can be retrofitted to clean the pressure roll 115 of a printing system that does or does not include a cleaning unit 121.

According to various embodiments, the cleaning unit 121 has at least one cleaning member 125 that may be one or more of a roller-type, a web-type, an auger-type, or stationary-pad type cleaning member configured to contact a surface of the pressure roll 115.

Regardless of form of the cleaning member 125, the cleaning member 125 includes at least one compressible surface portion 127 configured to contact the pressure roll 115 and absorb transferred release agent from the pressure roll 115. In embodiments, the compressible porous surface comprises a porous material such as one or more of a open cell porous silicone or a nanowire mesh material.

In some embodiments, cleaning member 125 may be a roller comprised of a porous material, or be a multi-layer roller having a core comprising one or more materials and a surface skin comprising the porous material. Similarly, in other embodiments, a web-type cleaning member 125, an auger-type cleaning member 125, or a stationary-pad type cleaning member 125 may have one or more portions comprising the porous material.

The porous material, as discussed above, is configured to absorb release agent from the pressure roll 115 by capillary action. The cleaning member 125 is caused to contact the pressure roll 115 so that at least surface portion 127 compresses forming a cleaning nip with the pressure roll 115. Compressing the cleaning member 125 maximizes an amount of surface area that is in contact between the pressure roll 115 and the cleaning member 125. As the cleaning member 125 compresses against the pressure roll 115, the cleaning member 125 absorbs release agent from the pressure roll 115. The cleaning member 125 is caused to be compressed by a force exerted on the cleaning member 125 in a direction of the pressure roll 115. The force may be exerted by any means, either constantly or selectively.

The porous material, as discussed above, may be for example, an open cell porous silicone material. Such an open cell porous silicone material may be, for example but not limited to, an extruded silicone foam rubber having a durometer value in the range of about 25-35 based on an ASKER type-C test. Alternatively, the porous material may be, for example, a nanowire mesh material. Nanowire mesh materials are capable of absorbing up to 20 times their weight in release agent, and serve to effectively clean the pressure roll 115 to reduce or eliminate any image related defects caused by release agent that may be transferred to the imaging surface 108 in a duplex printing mode.

According to various embodiments, the cleaning member 125 may be fixed so that the cleaning member 125 is always in contact with the pressure roll 115, or movable so that the cleaning member 125 may selectively clean the pressure roll 115.

If the cleaning member 125 is movable, the cleaning member 125 may be caused to be moved away from the pressure roll 115 so that it only contacts the pressure roll 115 on demand, or as instructed, based on a particular determined print job attribute such as a determined type of print job (i.e. simplex or duplex), determined print job length, a print job known to have a large or small amount of release agent coverage and carry back, a determined image quality threshold that may be set by an operator or detected by a sensor, or for any other reason that may affect image quality performance of the printing system 100. Such movement of the cleaning member 125 between an engaged cleaning position in contact with the pressure roll 115 and a disengaged position may reduce any wear that the cleaning member 125 and/or the pressure roll 115 may experience from any cleaning processes.

According to various embodiments, the cleaning unit 121 may index the positioning of the cleaning member 125 between the engaged position and the disengaged position by any of a camming mechanism, a solenoid loading mechanism, or any other type of motor or means for inducing a movement of the cleaning member 125.

According to various embodiments, if the cleaning member 125 is movable, the cleaning member 125 may be caused to contact the pressure roll 115 any combination of continually, periodically, before a print job, during a print job, after a print job, or during a warm-up or cool-down cycle of the printing system 100. For example, the cleaning member may be actuated specifically during the inter-document zone, discussed above.

According to various embodiments, the cleaning unit 121 may additionally include a compression member such as a blade or wick that could be added to avoid release agent saturation of the cleaning member 125 and to reduce or eliminate the need for replacing the cleaning member 125, or at least the porous material. For example, the compression member may be configured to deform at least the compressible surface of the cleaning member 125 such that absorbed release agent is squeezed out and released from the cleaning member 125. The released release agent, in some embodiments, may be collected by a reservoir and re-used by the printing system 100. By collecting excess release agent in a reservoir, this release agent could be collected and reused making the system 100 better for the environment and more cost efficient.

According to various embodiments, the compression member, as discussed above, may be any of a static blade or wick. But, in other embodiments, the compression member may be any of a roller-type that rotates about an axis or an auger. In some embodiments, the compression member may be configured to move back and forth in a direction parallel to an axis about which the cleaning member 125 moves to drive release agent in a predetermined direction.

In some embodiments, the cleaning member 125 itself may be configured to move back and forth in a direction parallel to an axis about which the pressure roll 115 rotates to drive release agent in a predetermined direction such as an in board or out board direction, for example.

Depending on material, the cleaning member 125 may be configured to alternatively, or additionally, act as a squeegee and cause the release agent to be spread evenly on the pressure roll 115 causing the amount of release agent to be smeared into a thinner layer than before being contacted by the cleaning member. Thinning the layer of release agent may enable a reduced amount of release agent to be carried back to the imaging surface 108, or enable an even amount of release agent to be carried back so that the effect of release agent on a sheeted media 104 is uniform over an image area of the sheeted media 104.

The cleaning unit 121 reduces the amount of release agent that may be transferred to the imaging surface 108 by removing or smearing any release agent that may be present on a surface of the pressure roll 115. Less release agent is transferred to the non-image side of the media 104, and thus less release agent is transferred back to the imaging surface 108, thereby reducing image related defects. The cleaning unit 121, therefore, reduces the number of time an imaging surface 108 needs to be replaced due to release agent related issues, and also eliminates or at least reduces the amount of cleaner sheets that may need to be run by a printing system to reduce the amount of release agent transferred to an imaging surface because the cleaning unit 121, for example, is capable of absorbing so much of the release agent itself as opposed to merely displacing it. The cleaning unit 121 also reduces the number of times a fixing roll 113 needs to be replaced for various image quality issues that are caused by release agent carry back to the imaging surface 108, but are misdiagnosed as being a fixing roll 113 issue.

Figure 2:
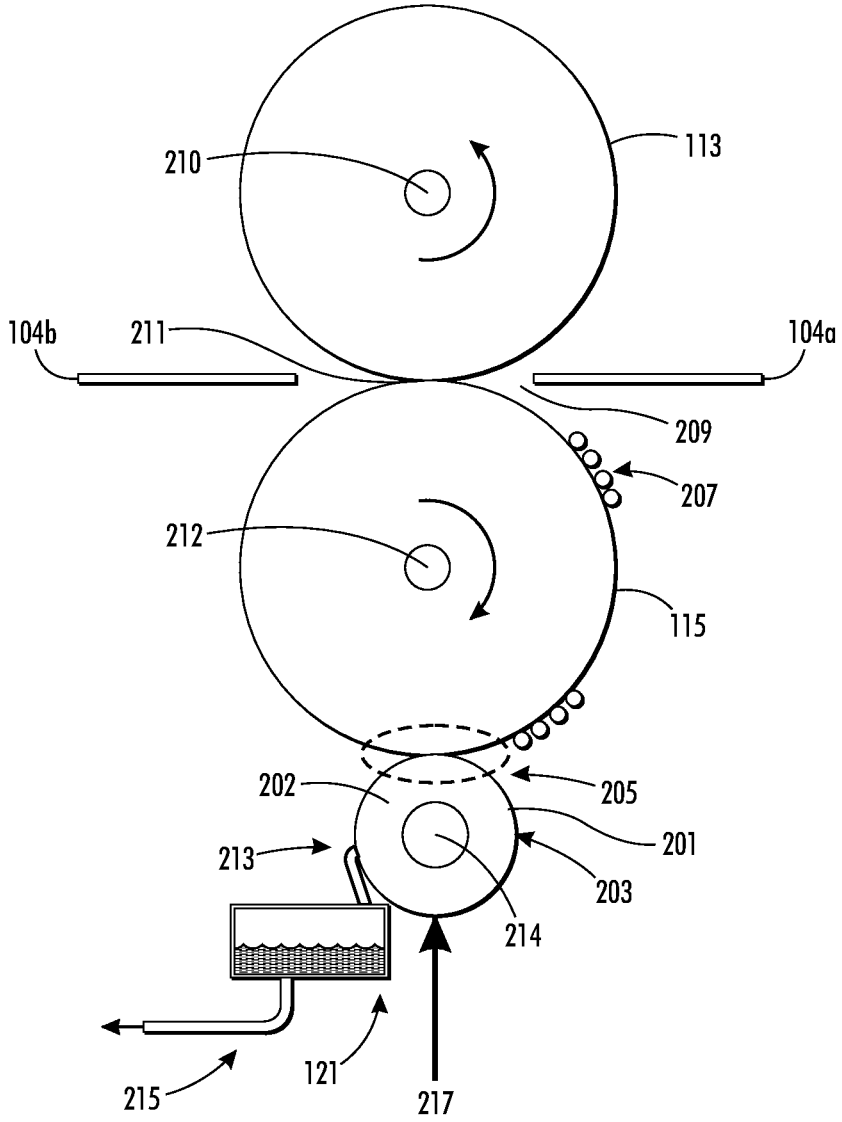
FIG. 2 is a diagram of the components of a cleaning unit having a cleaning member that is a roller, according to one embodiment.

FIG. 2 is a diagram of an example embodiment of the cleaning member 125. In this example, the cleaning member 125 of the cleaning unit 121, discussed above, is illustrated as being a cleaning roll 201.

The fixing member 113 rotates about a fixing roll center axis 210 while the pressure roll 115 rotates about a pressure roll center axis 212 to advance sheeted media 104 through fusing nip 211. Release agent is applied to the fixing roll 113, as discussed above, to help the sheeted media 104 strip from the fixing roll 113 after the image has been fused to the sheeted media 104. Release agent 207, however, builds on the pressure roll 115 when release agent is transferred from the fixing roll 113 to the pressure roll 115 in the inter-document zone 209 that occurs between, for example, a first sheeted media 104*a* and a second sheeted media 104*b* that sequentially pass through the fusing nip 211.

The cleaning roll 201 has a compressible surface 203. As discussed above, the cleaning roll 201 contacts a surface of the pressure roll 115 at a cleaning nip 205 to remove, or at least smear, release agent 207 while the cleaning roll 201 rotates about its own center axis 214. As the cleaning roll 201 contacts the pressure roll 115, release agent 207 is transferred from the pressure roll 115 to the cleaning roll 201. Release agent 207, in some embodiments, is absorbed by the cleaning roll 201 by way of capillary action, for example, depending on a material of the cleaning roll 201. For example, the cleaning roll 201 may include at least a compressible surface 203 that is of a porous material, for example. In other embodiments, the cleaning roll 201 may have a cleaning roll core 202 that is comprised of the same or different porous material as the compressible surface 203, and the cleaning roll core 202 may be a unitary piece with the compressible surface 203, or the cleaning roll core 202 may be a completely separate piece of the cleaning roll 201 from that of the compressible surface 203.

Also illustrated is a compression member 213 that is configured to scrape and/or deform at least the compressible surface 203 of the cleaning roll 201 to cause, at least in part, release agent 207 to be released from the cleaning roll 201, or at least smeared on the cleaning roll 201. In embodiments, as discussed above, the compression member 213 may be any of a blade, a wick, another roller, and auger etc. For example, the compression member 213 may cause absorbed release agent 207 to be squeezed from the cleaning roll 201, in some embodiments. In this example, the compression member 213 is associated with a release agent collection reservoir 215 that is configured to collect release agent 207 that is removed from the cleaning roll 201 by the compression member 213. Release agent 207 that is collected in the release agent collection reservoir 215 may be reused by the system 100 to reduces production costs and to also reduce waste.

In embodiments, the cleaning roll 201 may be caused to deform against the pressure roll 115 by a force 217 applied to the cleaning roll 201 in a direction of the pressure roll 115. The force 217 causes the cleaning roll 201 to engage the pressure roll 115 to ensure maximum coverage of the pressure roll 115 in the cleaning nip 205. In some embodiments, the force 217 may be selectively applied so as to actuate the pressure roll 115 for any reason such as a determination that a print job attribute meets a predetermined criteria, or on demand, for example, as discussed above. In embodiments, the force 217 may be applied by any means such as, but not limited to, a motor, a spring, etc. to axis 214 of the cleaning roll 201, for example. In other embodiments, the force 217 may be constant such as if the cleaning roll 201 is stationary, for example.

Figure 3:
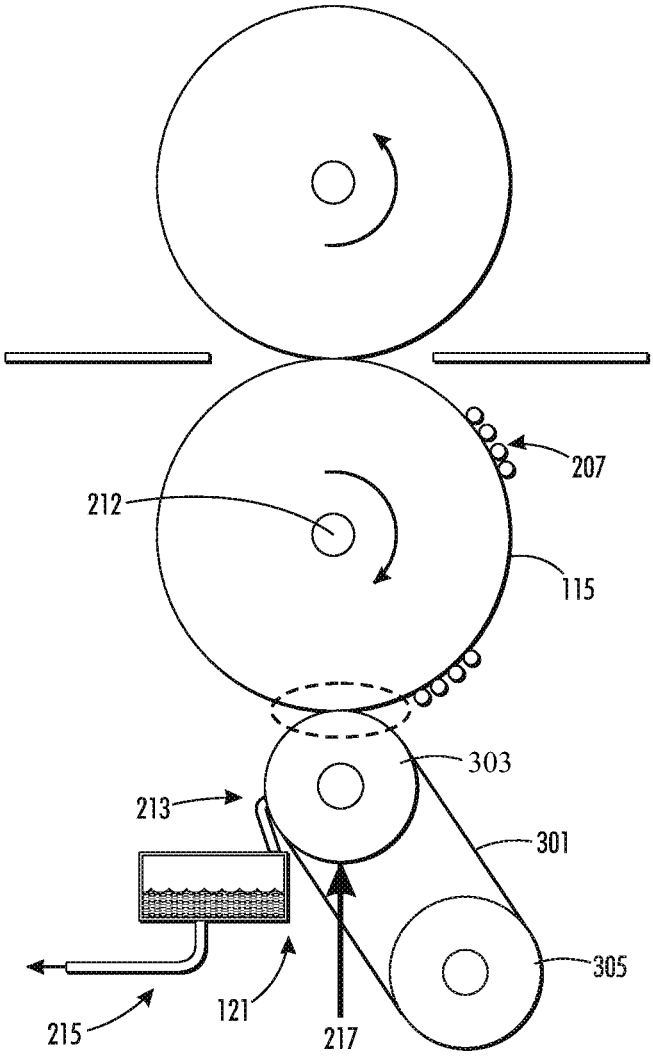
FIG. 3 is a diagram of the components of a cleaning unit having a cleaning member that is a web, according to one embodiment.

FIG. 3 is a diagram of an example embodiment of the cleaning member 125. In this example, the cleaning member 125 is illustrated as being a cleaning web 301 that is advanced around a web cleaning roller 303 and a guide roller 305. The cleaning web 301 is configured to absorb or at least smear release agent 207 that is transferred to the pressure roll 115 from the fixing roll 113. The cleaning unit 121 may include more than the two rollers that are illustrated, or simply have a single roller around which the cleaning web 301 is wrapped. In some embodiments, the cleaning web 301 may be continuously reused, while in other embodiments, the cleaning web 301 may be caused to contact the pressure roll 115 and wound by the guide roller 305, for example, after a particular portion of the cleaning web 301 is used to clean the pressure roll 115. As discussed above, the cleaning web 301 may be comprised entirely or partially of a porous material such as a porous silicone material or a nanowire mesh material. Other than form, the cleaning web 301 has the same or similar interactions with the pressure roll 115, release agent 207, pressure roll center axis 212, compression member 213, release agent collection reservoir 215, and force 217, as that of the cleaning roll 201, etc., discussed above.

Figure 4:
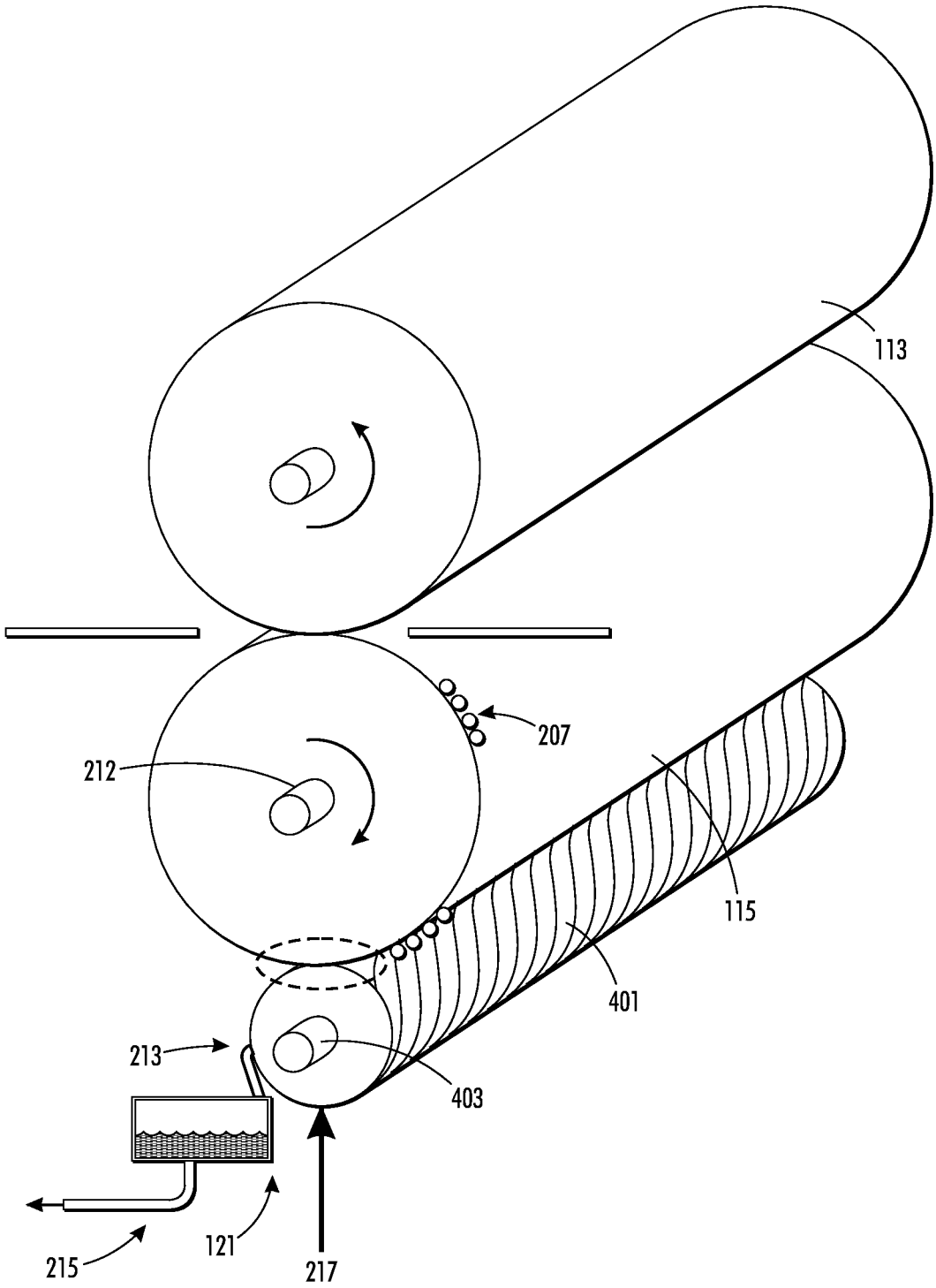
FIG. 4 is a diagram of the components of a cleaning unit having a cleaning member that is an auger.

FIG. 4 is a diagram of an example embodiment of the cleaning member 125. In this example, the cleaning member 125 is illustrated as being a cleaning auger 401 that is rotated about a center axis 403. The cleaning auger 401 is configured to absorb or at least smear release agent 207 that is transferred to the pressure roll 115 from the fixing roll 113. In some embodiments, the cleaning auger 401 may be configured to drive release agent 207 in a predetermined direction such as toward release agent collection reservoir 215, or an inboard or outboard direction, for example. In some embodiments, the cleaning auger 401 may be comprised entirely or partially of a porous material such as a porous silicone or a nanowire mesh material. Other than form, the cleaning web 301 has the same or similar interactions with the pressure roll 115, release agent 207, pressure roll center axis 212, compression member 213, release agent collection reservoir 215, and force 217, as that of the cleaning roll 201, etc., discussed above.

Figure 5:
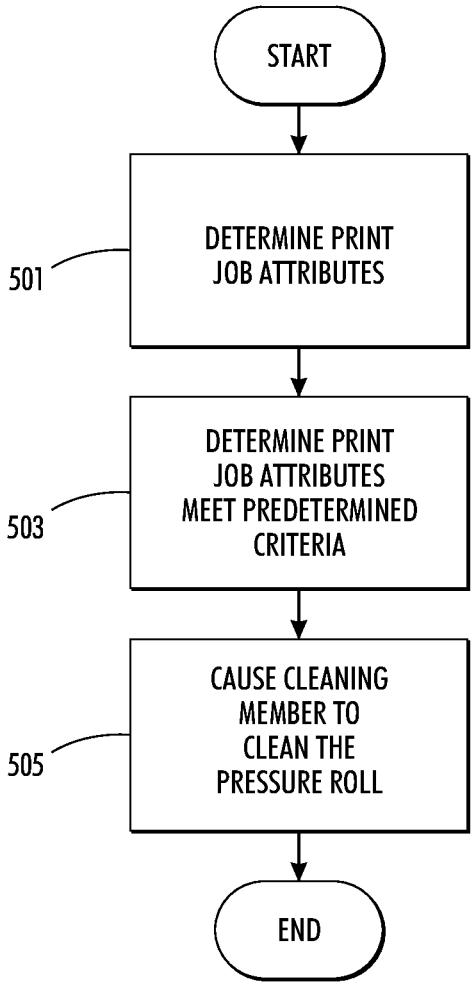
FIG. 5 is a flowchart of a process for cleaning a pressure roll of a fuser unit, according to one embodiment.

FIG. 5 is a flowchart of a process for cleaning a pressure roll of a fuser unit, according to one embodiment. In one embodiment, the cleaning unit 121, discussed above, performs the process 500. In step 501, the cleaning unit 121 determines a print job attribute associated with a print job to be processed by the printing system 100, discussed above. Then, in step 503, the cleaning unit 121 determines the print job attribute meets a predetermined criteria. According to various embodiments, the predetermined criteria includes at least one or more of a threshold level of release agent applied to a media 104 while processing the print job, a type of the print job, and a length of the print job. Each criteria may be preset to correspond to a particular value that triggers cleaning unit 121 to cause the cleaning member 125 to contact the pressure roll 115, discussed above.

Next, in step 505, the cleaning unit 121 causes, at least in part, the cleaning member 125 to clean the pressure roll 115 in response to the determination that the print job attribute meets the predetermined criteria or on demand. Cleaning the pressure roll may include any combination of causing the cleaning member 125 to contact the pressure roll and/or move in a direction parallel to an axis about which the cleaning member 125 moves. According to various embodiments, depending on operator preference and/or any determined print job attributes, the cleaning member 125 may be caused to contact the pressure roll 115 during, before or after a print job, during a warm-up or cool-down cycle of the printing system 100, on demand, or any combination thereof.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

Although the above description is directed toward a fuser unit, such as a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

What is claimed is:

1. An apparatus useful in printing, the apparatus comprising:

a fuser unit comprising a pressure roll; and a cleaning member having a compressible surface portion configured to contact the pressure roll, the compressible surface portion comprising a porous material configured to absorb a release agent from the pressure roll;

wherein the cleaning member comprises an auger having the compressible surface portion, the auger further being configured to drive the release agent in a predetermined direction.

2. An apparatus of claim 1, wherein the porous material comprises one or more of an open cell porous silicone and a nanowire mesh material.

3. An apparatus of claim 2, wherein the porous material comprises a durometer value of 25-35.

4. An apparatus of claim 2, further comprising:

a reservoir configured to collect release agent released by the cleaning member when a compression member is caused to deform the compressible surface portion of the cleaning member.

5. An apparatus of claim 1, further comprising:

a compression member configured to deform the compressible surface portion of the cleaning member to cause, at least in part, release agent absorbed by the cleaning member to be released by the cleaning member from at least the compressible surface portion of the cleaning member being deformed.

6. An apparatus of claim 5, further comprising:

a reservoir configured to collect release agent released by the cleaning member when the compression member is caused to deform the compressible surface portion of the cleaning member.

7. An apparatus of claim 1, wherein the cleaning member is configured to be moved along a direction parallel to an axis of rotation about which the cleaning member is rotated.

8. An apparatus of claim 1, wherein the cleaning member comprises a roller having the compressible surface portion.

9. An apparatus of claim 1, wherein the cleaning member comprises a cleaning web having the compressible surface portion.

10. An apparatus of claim 1, wherein cleaning member is configured to contact the pressure roll in response to a determination that a print job attribute associated with a print job to be processed by the fuser unit meets a predetermined criteria.

11. A method useful in printing, the method comprising:

causing, at least in part, a cleaning member having a compressible surface portion configured to contact a pressure roll of a fuser unit, the compressible surface portion comprising a porous material configured to absorb a release agent from the pressure roll;

wherein the cleaning member comprises an auger having the compressible surface portion, the auger further being configured to drive the release agent in a predetermined direction.

12. A method of claim 11, wherein the porous material comprises one or more of an open cell porous silicone and a nanowire mesh material.

13. A method of claim 12, wherein the porous material comprises a durometer value of 25-35.

14. A method of claim 13, further comprising: causing a reservoir configured to collect release agent released by the cleaning member when a compression member is caused to deform the compressible surface portion of the cleaning member.

15. A method of claim 11, further comprising:

causing, at least in part, a compression member configured to deform the compressible surface portion of the cleaning member to cause, at least in part, release agent absorbed by the cleaning member to be released by the cleaning member from at least the compressible surface portion of the cleaning member being deformed.

16. A method of claim 15, further comprising:

causing, at least in part, a reservoir configured to collect release agent released by the cleaning member when the compression member is caused to deform the compressible surface portion of the cleaning member.

17. A method of claim 11, wherein the cleaning member is configured to be moved along a direction parallel to an axis of rotation about which the cleaning member is rotated.

18. A method of claim 11, wherein the cleaning member comprises a roller having the compressible surface portion.

19. A method of claim 11, wherein the cleaning member comprises a cleaning web having the compressible surface portion.

20. A method of claim 11, wherein cleaning member is configured to contact the pressure roll in response to a determination that a print job attribute associated with a print job to be processed by the fuser unit meets a predetermined criteria.

* * * * *